United States Patent [19]

Koch et al.

[11] 4,406,089

[45] Sep. 27, 1983

[54] CABLE WINDOW DRIVING MECHANISM FOR MOTOR VEHICLES

[75] Inventors: Wilhelm Koch, Ebelsbach; Gerhard Schust, Weidhausen, both of Fed. Rep. of Germany

[73] Assignee: Brose Fahrzeugteile GmbH & Co. Kommanditgesellschaft, Coburg, Fed. Rep. of Germany

[21] Appl. No.: 372,794

[22] Filed: Apr. 28, 1982

[30] Foreign Application Priority Data

May 8, 1981 [DE] Fed. Rep. of Germany ..... 3118311

[51] Int. Cl.[3] ..... E05F 11/48

[52] U.S. Cl. ..... 49/352; 49/360

[58] Field of Search ..... 49/352, 360, 348, 349

[56] References Cited

U.S. PATENT DOCUMENTS 4,109,417 8/1978 Fogarollo ..... 49/352

4,199,899 4/1980 Muhling et al. ..... 49/352

*Primary Examiner*—Philip C. Kannan

*Attorney, Agent, or Firm*—Toren, McGeady & Stanger

[57] ABSTRACT

A window driving assembly particularly for a motor vehicle having an elongated guide rail upon which a driven member having a windowpane supported thereon is mounted for sliding guided movement between two terminal positions. A cable extends from a cable drive mechanism over a pair of deflection pulleys located at opposite ends of the guided path of the driven member into engagement with opposite ends of the driven member. In order to extend the length of the path of movement of the driven member or to shorten the distance between the deflection pulleys, the cable is connected at runoff points at opposite ends of the drive member which, when the drive member is at a midway point in its path of travel, are farthest away from the deflection pulley to which they are connected.

22 Claims, 6 Drawing Figures

CABLE WINDOW DRIVING MECHANISM FOR MOTOR VEHICLES

The present invention relates generally to window driving mechanisms and more particularly to a window driving mechanism for an automotive vehicle.

The invention pertains to a cable-type of window driving mechanism wherein a driven member upon which the window is mounted is guided along a guide rail and moved between terminal points by a traction cable or Bowden cable which is attached to the driven member. In mechanisms of this type, the traction cable is usually guided along a cable loop from a first runoff point at which it is attached on the driven member over a first cable deflector located in the region of one of the terminal ends of the path of movement of the driven member to a cable drive mechanism. The cable is also connected from a second runoff point on the driven member over a second deflection pulley to the cable drive and when the cable is driven in one of two given directions, it will drive the driven member and the window in the appropriate direction of movement.

In known cable window driving mechanisms of this type, the cable usually follows a course which lies along a straight line between the two cable deflection pulleys along the guide rail and the cable is fastened on the driven member by means of an elongated cable nipple. The end of the cable nipple which is situated closest to the first cable deflection pulley forms the first runoff point of connection of the cable to the driven member, and the other end of the nipple situated nearest to the second cable deflection pulley forms the second runoff point.

In a known cable window driving mechanism of this type, the maximum degree of movement or stroke of the window driving system is limited by the fact that the first runoff point on the driven member cannot move beyond the first cable deflection pulley situated at one end of the guide rail. The same is true of the second runoff point on the driven member which is limited insofar as its terminal point of movement is concerned by the position of the second deflection pulley.

The present invention is directed toward providing a cable window driving mechanism of the type mentioned above wherein by a simple expedient, the distance or stroke of the window driven may be lengthened with the distance between the cable pulleys remaining unchanged or, conversely, whereby the distance between the deflection pulleys may be shortened for the same or a given length of window travel.

SUMMARY OF THE INVENTION

Briefly, the present invention may be defined as a vehicle window driving assembly comprising guide rail means extending generally in a longitudinal direction, a driven member adapted to have a window mounted thereon engaging said guide rail means for guided movement therealong in said longitudinal direction between a first and a second terminal position, cable means attached to said driven member for driving said driven member along said guide rail means between said first and said second terminal positions, cable drive means for actuating said cable means, first deflection means proximate said first terminal position and second deflection means proximate said second terminal position, said cable means extending from a first runoff position on said driven member over said first deflection means to said cable drive means and from a second runoff position on said driven member over said second deflection means to said cable drive means, said first and said second runoff positions being located on opposite sides of said driven member taken in said longitudinal direction with said first runoff position being on a side of said driven member toward said second deflection means and with said second runoff position being on a side of said driven member toward said first deflection means when said driven member is located midway between said first and second terminal positions.

Of course, the first and second deflection means may be deflection pulleys and as a result of having the cable means running from each of the deflection pulleys connected to a runoff point on the driven member which is farthest away from a given deflection pulley when the driven member is intermediate or midway between the terminal positions of its travel, the stroke of the driven member may be extended so that the end of the driven member closest to one terminal position may move well beyond the deflection pulley proximate that terminal position during its stroke of movement.

Of course, the first and second runoff positions on the driven member may be staggered or spaced apart taken in a direction perpendicular to the longitudinal direction of travel of the driven member and also the first and second deflection means or pulleys may likewise be staggered or offset relative to each other in a direction perpendicular to the longitudinal direction of the guide rail. As a result, the cable means which extend between the deflection pulleys and the driven member and which may intersect along the path of travel thereof will not interfere with proper operation of the device.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
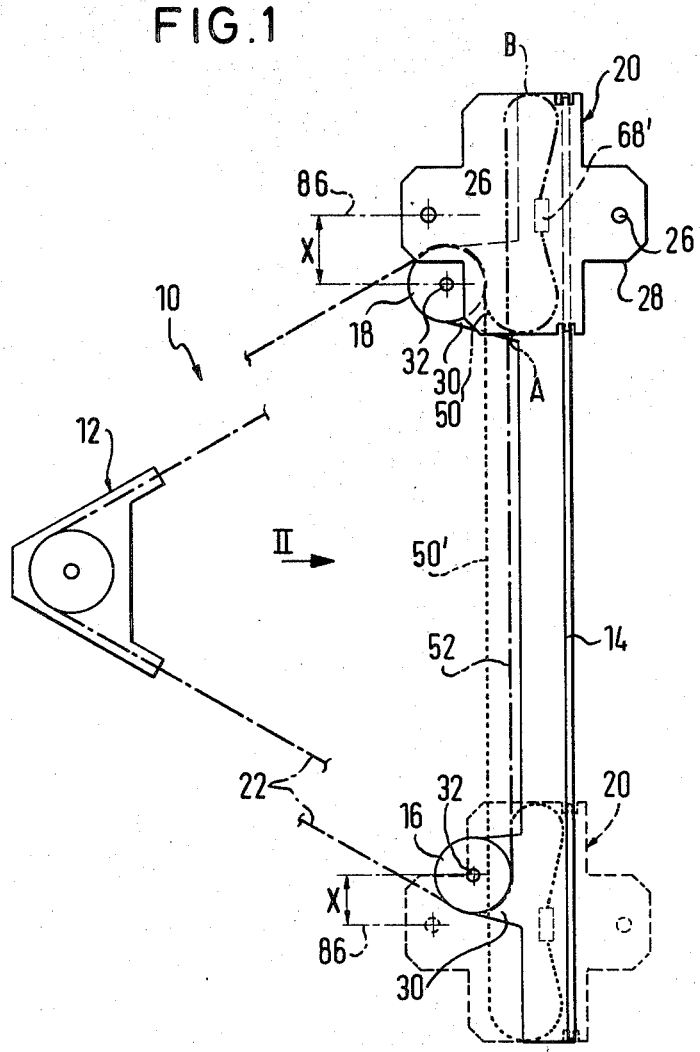
FIG. 1 is a schematic side elevation or view of the window drive mechanism of the present invention.
Figure 2:
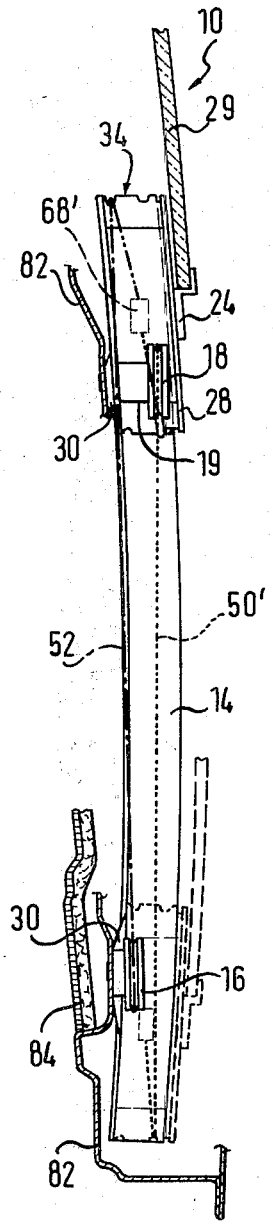
FIG. 2 is an edge or end view of the mechanism shown in FIG. 1 taken along the direction II.

The basic system for driving a motor vehicle window between two terminal positions is depicted schematically in FIGS. 1 and 2. The windowpane is identified by reference numeral 29 in FIG. 2 and it is shown in FIG. 2 in solid line in its uppermost position and in dotted line in its lowermost position.

The windowpane 29 is mounted upon a driven member 20 which, similarly, is shown in solid line form in its uppermost position and in dotted line form in its lowermost position.

The overall drive mechanism for raising and lowering the window is identified with reference numeral 10 in FIG. 1, and the driven member 20 and the windowpane 29 are driven between the top and bottom terminal positions by a cable drive mechanism 12 through a traction drive cable 22 which is connected with the driven member 20. It will be apparent that the cable drive mechanism 12, which is indicated only schematically, may be driven manually by means of a crank handle or automatically by an electric motor or the like.

Figure 5:
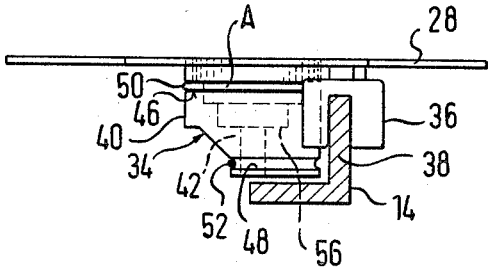
FIG. 5 is a view partially in section of the drive member of FIGS. 3 and 4 taken along the line V—V.

The driven member 20 is mounted for sliding guided movement along an elongated guide rail 14 which has an L-shaped cross-section best seen in FIG. 5 and which is arranged with its longitudinal dimensions extending essentially vertically but, at the same time, being slightly bent as indicated in FIG. 2.

The cable system 22 is arranged to extend from the cable drive mechanism 12 over a pair of pulleys 16 and 18 which operate to guide or deflect the cable 22 during its movement to drive the driven member 20 along the guide rail 14 between the upper and lower terminal positions.

The basic concepts of the invention relate to the manner in which the cable 22 is attached to the driven member 20 in order either to enlarge the stroke or path of movement of the driven member 20 or to reduce the spacing between the deflection pulleys 16 and 18. As will be noted from FIG. 1, there are indicated on the driven member 20 runoff points A and B on the driven member 20. The part of the cable 22 which extends over the guide pulley 18 is connected to the runoff point A, and the part of the cable 22 which extends over the guide pulley 16 is connected to the runoff point B. Thus, it will be seen that the cable 22 extends from engagement with the upper pulley 18 to a runoff point A on the driven member 20 which is the lowermost of the runoff points and that the part of the cable 22 which extends about the lowermost pulley 16 is connected with the uppermost runoff point B on the driven member 20.

As a result, the driven member 20 may be actuated so that the runoff point B will extend to a position well above the upper pulley 18 when the driven member 20 is in it uppermost position and so that the runoff point A may extend well beyond the lowermost pulley 16 when the driven member 20 is in its lowermost position.

With the driven member in its lowermost position, the path of the cable 22 is shown in dotted line form and the portion of the cable extending between the uppermost deflection pulley 18 and the runoff point A is labeled 50'. With the driven member 20 at its lowermost position, the cable will extend from the driven member 20 at the runoff point B around the lowermost deflection pulley 16.

The position of the cable 22 with the driven member 20 in its uppermost position is indicated in dash-dot and dash-dot-dot line and, as will be noted from FIG. 1, with the driven member 20 in its uppermost position, the part of the cable labeled 52 will extend from the lowermost deflection pulley 16 to the uppermost runoff point B and then through the driven member 20 to the lowermost runoff point A onto the uppermost deflection pulley 18.

As a result, the advantages indicated previously are achieved by this arrangement of the system.

The driven member 20 is formed to include a plate member 28, and a horizontally extending support rail 24 which is shown only in FIG. 2 is attached by means of screw connections (not shown) to the plate member 28 at holes 26. The support rail 24 is structured to support the lower transverse edge of the windowpane 29, as indicated in FIG. 2.

The deflection pulleys 16 and 18 are attached to the longitudinal guide rail 14 at bearing plates 30 projecting to the left from the guide rail 14 at upper and lower positions thereon. The deflection pulleys 16 and 18 are connected, respectively, to a bearing plate 30 by bearing pins 32.

As previously indicated, the driven member 20 is composed of a plate member 28 which is a stamped metal sheet member. The driven member 20 also includes a drive block 34 which is attached to the plate member 28 and guide blocks 36 which are located at the upper and lower ends of the driven member 20 and which extend into guiding engagement with a leg 38 of the guide rail 14 in order to permit sliding guided movement of the driven member 20 along the guide rail 14.

It should be noted that in the embodiment depicted in FIG. 1, the cable 22 extends freely between the cable drive mechanism 12 and the deflection pulleys 16 and 18, but that this cable may also be provided in the form of a guided Bowden cable covering or sheet.

Figure 3:
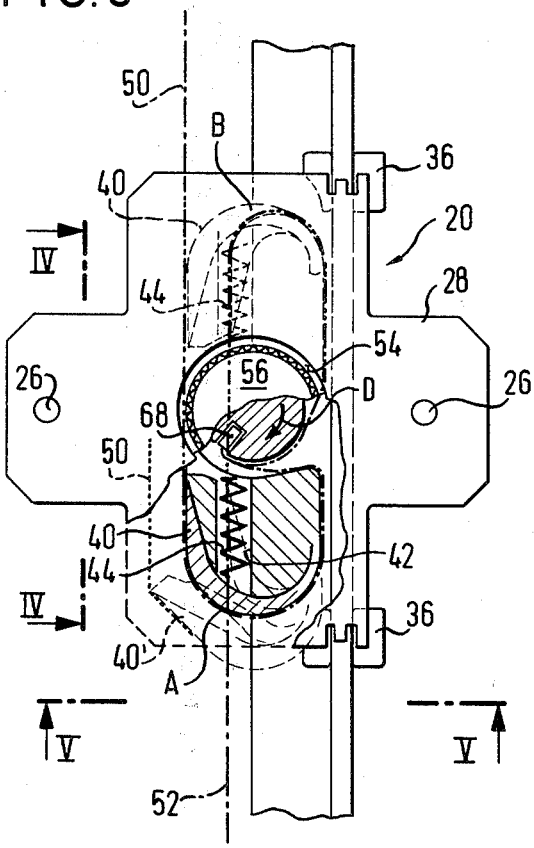
FIG. 3 is a detailed side view partially broken away showing the driven member of the window drive mechanism and parts thereof in more detail.
Figure 4:
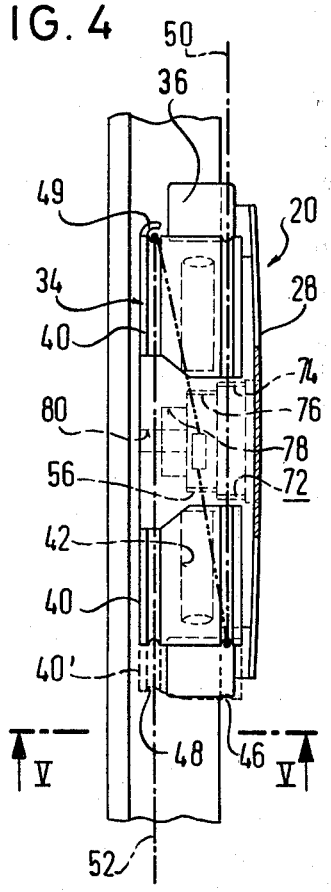
FIG. 4 is an edge or end view partially in section of the driven member of FIG. 3 taken along the line IV—IV.

The construction of the drive block 34 is best seen by reference to FIGS. 3, 4, and 5. The block 34 is constructed to include at each of its longitudinal ends a bracket 40 with a helical spring 44 being disposed in a longitudinal channel 42 of the drive block 34 in order to apply a spring force between the brackets 40 situated at opposite ends of the drive block 34. The spring 44 operates to apply a spring force tending to urge the brackets 40 away from each other.

The lowermost bracket 40 is shown in dotted line in FIGS. 3 and 4 and identified by reference numeral 40' when it is in a position pressed outwardly by the helical spring 44 as a result of inadequate tension in the traction cable 22. The traction cable 22 is guided by the drive block 34 and the brackets 40 and when adequate tension in the cable 22 exists, the brackets 40 will be urged back to their solid line positions shown in FIG. 4 against the force of the spring 44.

It will be noted that the drive block 34 and the brackets 40 are formed to include a pair of cable grooves 46 and 48 within which the traction cable 22 is guided.

Indicated in FIG. 3 in dotted line form is the course of the traction cable 22, and in this case there is indicated more precisely the course of the cable section 50 which extends between the driven member 20 and the guide pulley 18. The cable section extending between the driven member 20 and the lower guide pulley 16 is, as previously indicated, identified by reference numeral 52. FIG. 5 shows that the diameter of the cable groove 46 (which according to FIG. 3 extends along a cylindrical circumferential surface and is situated next or nearest to the plate member 28) is greater than the diameter of the other cable groove 48 so that the cable section 52 in general constantly runs off from the driven member 20 at a (changing) runoff point that is situated closer than the runoff point of the other cable section 50 to the leg 38 of the guide rail 14. As FIG. 4 shows, however, the two grooves 46 and 48 terminate in the longitudinal direction approximately at equivalent heights.

Figure 6:
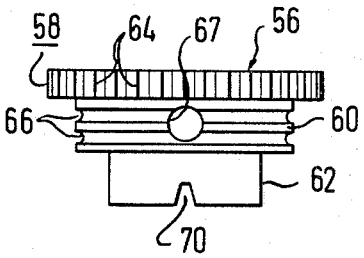
FIG. 6 is an edge view of a cable tensioning insert shown as part of the driven member depicted in FIGS. 3 and 4.

A cable tensioning or clamping insert 56 shown in enlarged form in FIG. 6 is inserted into the drive block 34 through a corresponding circular opening 54 in the plate member 28. The cable clamping insert 56 is composed of three coaxial and approximately cylindrical sections which are arranged one behind the other and which include a fastening section 58, a winding section 60, and a guide section 62. The fastening section 58 is constructed in the form of cylindrical gearing 64 and the winding section 60 is constructed with cable grooves 66 and a radial reception aperture 67 for engagement therein of a cable nipple 68 shown in FIG. 3. The guide section 62 is formed as a smooth cylindrical member. A slot 70 is provided on the front surface of the guide section 62 for engagement therein of a screwdriver.

As indicated in FIG. 4, a reception aperture 72 is provided in the drive block 34 for receiving therein the cable tensioning insert 56. The aperture 72 is constructed to include parts which are essentially complementary to the parts of the cable tensioning insert 56. Thus, the aperture 72 is successively formed with an internal gearing section 74, a winding section 76, and a guide section 78, the guide section 78 being adapted to form a seat for rotation of the guide section 62 with an annular space for winding being formed between the two winding sections 60 and 76. Furthermore, another engagement aperture 80 is provided for introduction of the screwdriver into the drive block 34, as seen in FIG. 4. The axial length of the guide section 62 of the cable tensioning insert exceeds the axial length of the fastening section 58. For tensioning the traction cable, the cable nipple 68 which affixes the two ends of the traction cable is inserted into the reception aperture 67, and the cable tensioning insert 56 is inserted so far into the reception aperture 72 of the drive block 34 that, although the guide section 62 does not engage into the corresponding section 78, nevertheless the cylindrical gearing 64 will not yet engage into the internal gearing section 74 and so the cable tensioning insert 56 can, in accordance with FIG. 3, be turned clockwise, for example by means of a screwdriver pushed into the engagement aperture 80. Once the desired cable tensioning is achieved, the cable tensioning insert is simply pushed into the drive block 34 until the toothed gearings engage in a positive or interlocking manner with each other.

From the cable tensioning insert 56, the two cable sections 50 and 52 will extend in opposite directions to the cable grooves 46 and 48, as indicated schematically in FIG. 4.

In FIGS. 1 and 2, the cable nipple 68′ is anchored directly in the drive block 34 without the use of a cable tensioning insert.

FIG. 2 shows by way of example the cable window driving mechanism 10 installed in a motor vehicle door. In the lower portion there is seen an inside sheet metal door panel 82 which from a certain height is covered by an inner door lining 84 inwardly, i.e., to the left in FIG. 3. The continuation of the inside door panel 82 is indicated in FIG. 2. It will be seen that the guide rail 14 extends nearly to a lower edge of the inside door panel 82. The lower guide or deflection pulley 16, on the other hand, is located at a higher position where it is more easily accessible for assembly and where it may be protected by the inner lining 84 of the door.

As a result of the construction of the window driving mechanism 10 in accordance with the present invention, there is achieved an expansion or extension of the lift or stroke of the window opening device with the spacing between the deflection pulleys 16 and 18 remaining unchanged. That is, without requiring any change in the spacing between the bearing pins 32 of the deflection pulleys 16 and 18, the overall distance across which the driven member 20 may be moved will be extended merely by utilization of the system of the invention. As shown in FIG. 1, in the upper end position, the drive member 20 will have its centerline 86, which defines the position of the support rail 24, located a distance X above the centerline or bearing pin 32 of the upper deflection pulley 18. Correspondingly, with the driven member 20 in its lowermost position, shown in broken line form in FIG. 1, the centerline 86 of the driven member 20 will be disposed a distance X below the centerline or bearing pin 32 of the lower deflection pulley 16.

This extension of the stroke of the driven member 20 is achieved by a crosswise arrangement of the runoff points on the driven member 20 from which the corresponding cable sections 50 and 52 run off from the driven member 20 to the guide pulleys 16 and 18, respectively. Specifically, as previously indicated and as shown in FIG. 1, the runoff point A for the cable section 50 which extends to the upper deflection pulley 18 is located at the lower longitudinal end of the driven member 20, while the runoff point B from which the cable section 52 extends to the lower deflection pulley 16 is disposed at the upper longitudinal end of the driven member 20. Hence, in an extreme case, the lower edge of the driven member 20 may be situated at the same height as the upper deflection pulley or roller 18 and correspondingly, the upper edge can be situated at the same height as the lower deflection pulley 16. The greater the distance between the runoff points A and B, the greater will be the gain in the stroke of the driven member 20.

The offset arrangement of the runoff points A and B operate to ensure that the cable sections 50 and 52 will not, in any position of the cable driving mechanism 10, come into contact with each other or with the deflection pulley assigned, respectively, to the other cable section. The course of the cable in both end positions of the mechanism 10 is indicated in FIGS. 1 and 2 and, as previously noted, a dash-dot line and a dash-dot-dot line is used to represent the upper terminal position of the member 20 and a dotted line is used to indicate the lower terminal position. No fundamental difference results in the cable course in the region between both terminal positions. In the upper end position, it must be ensured that the section 52 does not come into conflict with the upper guide or deflection pulley 18. This is ensured, since according to FIG. 1 the section 52 passes the pulley 18 with clearance, which fact may be attributed to the smaller radius of the corresponding groove 48 (see FIG. 5). In accordance with FIG. 2, the section 52 additionally extends in the axial direction vis-a-vis the roller 18 and is offset in relation to a reduced diameter shaft 19 of the roller 18 so that contact with the deflection roller 18 or the shaft 19 may be avoided.

In the lower terminal position, it must be ensured that the cable section 50′ extending to the upper pulley 18 does not come into contact or conflict with the lower pulley 16. As shown in FIGS. 1 and 2, the cable section 50′ runs above, but at a sufficient distance from, the pulley 16. In one embodiment of the cable tensioning insert deviating from that shown in the representation of FIG. 6, the fastening section 58 is constructed with a sawtooth circumferential toothing or gearing and so also is the section 74 of the reception aperture 72 of the drive block 34. The teeth of the two sawtoothed circumferential gearings are elastic or flexible in such a manner that when a turn is made and the flat teeth surfaces or flanks are moved toward each other, the teeth can pass each other, whereas when a turn is attempted in the opposite direction, the steep, mutually adjacent flanks of the teeth perform a blocking or locking action. Thus, in accordance with the invention, the sawtooth systems are oriented in such a way that it is possible for the cable tensioning insert 56 which is inserted into the drive block 34 to be rotated in the direction D shown in FIG. 3, that is, in the windup direction. By this mechanism, the cable tensioning is further simplified, since the cable tensioning insert no longer must be pushed axially for shifting or adjustment. Hence, the guiding action above-described of the cable tensioning insert on the drive block via the guide sections 62 and 78 is also eliminated. Additionally, the cable tensioning insert may be actuated exclusively from one side, that is, from above as seen in FIG. 5.

To facilitate mounting, drive hooks 49 may be provided on both of the partially cylindrical end sections. These drive hooks 49, one of which is indicated in the upper part of FIG. 4, also provide that the insufficiently tensioned traction cable which, because of its inherent rigidity constantly has the tension to follow a straight course, also in the untensioned state will extend around the drive block in the manner provided.

Automatic resetting with the aid of the prestressed brackets 40, and also adjustment of the cable length by means of the cable tensioning insert 56, may also be used advantageously with differently structured cable window drive mechanisms.

It will thus be seen that, in accordance with the present invention, the driven member may for example be drawn by the traction cable into its terminal position located in the region of the first cable deflection means or deflection pulley. This movement comes to an end at the latest when the first runoff point on the driven member 20 lies approximately at the same height level as the corresponding first cable drive. The second runoff point, meanwhile, has already been moved past the first cable deflection means. Assuming that the two runoff points are situated symmetrically in relation to the middle of the length or the longitudinal centerpoint of the driven member, the longitudinal middle is, in this case, shifted exactly half the distance between the two runoff points by means of the first deflection location away toward the end of the guide rail. The same applies correspondingly for the other window end position in the region of the second cable deflection means so that the result, as compared with the state of the art, is that the lift or stroke is increased by an amount of the present spacing or distance of the two runoff points, in addition to the length of the nipple in the state of the art. The additional shift or offset of the runoff points and/or of the cable deflection means in the manner indicated assures that the intersecting cable sections do not hinder each other or collide against the cable deflection means which are assigned to the respective other cable section. Thus, with the present invention, it is not a question of increasing the length of the lift or stroke of the cable window driving mechanism, since the construction of the cable window driving mechanism according to the invention makes it possible to reduce the spacing of the cable deflection means.

This is advantageous, for example, if the guide or deflection pulleys are used as cable deflection means since the pulleys with a larger diameter can be used with a small roller spacing or distance which is advantageous for the service life of the traction cable. Furthermore, reduction of the pulley spacing has under certain circumstances the further advantage that one of the cable deflection means or pulleys, for example the lower cable deflection pulley of the motor vehicle window mechanism, may be mounted in a region of the door where it can be conveniently located or where the point of mounting or assembly is covered in a better manner by the inner door panel or door lining.

It is proposed that the two runoff points and/or the two cable deflection means be staggered or offset against each other in a direction perpendicular to the plane of the windowpane. In this direction, there is generally sufficient structural space available. Also, no undesirable tilting forces in the plane of the window will occur in this arrangement.

Preferably, in addition to this offsetting arrangement, the two runoff points and/or the two cable deflection means can be offset against each other in a direction lying in the plane of the windowpane and at right angles to the longitudinal direction of the guide rail. By this means, the safety spacing between the mutually intersecting cable sections as well as between the cable sections and the cable deflection means can be increased further. It is also possible to have one of the cable deflection means cantilevered in the indicated offset direction and thereby to provide a more stable construction.

A maximum increase in the lift or stroke of the device is achieved by arranging the two runoff points each in the region of a longitudinal end of the driven member 20, i.e., the longitudinal ends taken relative to the longitudinal direction of the guide rails.

In a preferred embodiment of the invention, the traction cable 22 embraces in the region of each of the longitudinal ends of the driven member, a rounded end section of the drive block 34, said end section being preferably of a partially cylindrical shape. By this means, on the one hand, a buckling load on the traction cable is avoided and, on the other hand, the effect is achieved that the driven member may be moved far enough toward the cable deflection means until the semicylindrically shaped end section lies essentially at the same height level as the cable deflection means. Cable grooves are provided for guiding the traction cable around the end sections.

In one embodiment of the invention which is economical to produce and, at the same time, mechanically stable, the driven member comprises a drive plate which is preferably constructed as a stamped sheet metal member 28 and the drive block 34 is attached, preferably extruded, onto one side of the plate member.

In order to obtain a cable circulation that is low in friction and wear, it is proposed that at least one of the two cable deflection means be constructed as guide pulley or deflection roller.

In order to achieve the effect that the traction cable is constantly tensioned, the cable is guided on the driven member by means of at least one movable and preferably pivotable bracket which is prestressed by means of a spring, such as the spring 44, in order to effect a post-tensioning of the cable.

An economical manufacturing method is assured if the bracket is extruded onto the driven member or, as the case may be, the drive block.

In combination with the aforementioned increase in the lift or stroke in accordance with the invention, it is proposed that the bracket forms the semicylindrically shaped end section.

In order to enable the traction cable to be tensioned in a simple manner with simple means, the invention proposes that a cable clamping or tensioning insert be preferably provided in an approximately cylindrical shape which may be inserted into one or preferably several rotational positions into the driven member or, as the case may be, the drive block and which is constructed with a winding section for winding up at least one of the two traction cable ends. If necessary, this cable clamping insert may also be used in addition for the aforementioned automatic post-tensioning of the cable as well as for the increase of the lift or stroke.

The attachment of one or both cable ends may be achieved in an especially simple manner when a reception aperture for the cable nipple is provided in the region of the winding section 60.

The invention further proposes that the cable clamping or tensioning insert be formed with a fastening section which is constructed as an exterior polygon or is furnished with circumferential toothing or gearing 64 and that this fastening section engage positively or in a locking manner into a corresponding interior polygon or internal toothing of the driven member or, as the case may be, of the drive block. An embodiment of this type assures with simple means a reliable fastening of the cable or clamping insert in the respective desired rotational position.

In this connection, it is proposed that the cable clamping insert be provided with a cylindrical guide section 62 which is inserted axially movably into a guide aperture 72 of the drive member 34 and that the axial length of this guide section exceed that of the fastening section. In order to post-tension the cable, the cable clamping insert is pushed in the axial direction until the fastening section comes out of engagement with the corresponding interior polygon or interior toothing. Nevertheless, as proposed, the fastening section continues by means of its guide section to be supported on the drive member and continues to the desired post-tensioning, following which it can be pushed back again into engagement with the internal polygon or the internal toothing.

The versatility of service of the drive member, especially for window driving mechanisms in left-hand as well as right-hand doors of motor vehicles is assured if, as proposed, the drive block is constructed symmetrically in relation to the block center plane which is at right angles to the longitudinal direction of the rail.

While specific embodiments of the invention have been shown and described in detail to illustrate the application of the inventive principles, it will be understood that the invention may be embodied otherwise without departing from such principles.

What is claimed is:

1. A vehicle window driving assembly comprising: guide rail means extending in a generally longitudinal direction; a driven member adapted to have a window mounted thereon engaging said guide rail means for guided movement therealong in said longitudinal direction between a first and a second terminal position; cable means attached to said driven member for driving said driven member along said guide rail means between said first and said second terminal positions; cable drive means for actuating said cable means; first deflection means proximate said first terminal position and second deflection means proximate said second terminal position; said cable means extending from a first runoff position on said driven member over said first deflection means to said cable drive means and from a second runoff position on said driven member over said second deflection means to said cable drive means; said first and said second runoff positions being located on opposite sides of said driven member taken in said longitudinal direction with said first runoff position being on a side of said driven member toward said second deflection means and with said second runoff position being on a side of said driven member toward said first deflection means when said driven member is located midway between said first and second terminal positions.

2. An assembly according to claim 1 wherein said guide rail means and said driven member are structurally proportioned relative to each other in such a manner that said first runoff position may be moved into the region of said second deflection means and said second runoff position may be moved into the region of said first deflection means.

3. An assembly according to claim 1 wherein both said first and second runoff positions are offset relative to each other taken in a direction perpendicular to the direction of movement of said driven member.

4. An assembly according to claim 1 wherein both said first and second deflection means are offset relative to each other taken in a direcction perpendicular to the direction of movement of said driven member.

5. An assembly according to claim 1 wherein both said first and second runoff positions are offset relative to each other in a direction lying in the plane of said windowpane and perpendicularly to the longitudinal direction of said guide rail means.

6. An assembly according to claim 1 wherein both said first and second deflection means are offset relative to each other in a direction lying in the plane of said windowpane and perpendicularly to the longitudinal direction of said guide rail means.

7. An assembly according to claim 1 wherein said driven member is formed to include a drive block having rounded end sections with cable grooves engaging said cable means and defining said first and second runoff positions.

8. An assembly according to claim 7 wherein said driven member comprises a plate member structured as a stamped sheet metal member and having said drive block attached thereto on one side thereof.

9. An assembly according to claim 1 wherein at least one of said first and second deflection means comprise a guide pulley.

10. An assembly according to claim 1 wherein said driven member includes pivotable bracket means and prestressing spring means operably associated with said bracket means, with said cable means being engaged with said bracket means so as to be prestressed by operation of said spring means.

11. An assembly according to claim 10 wherein said bracket means is extruded onto said driven member.

12. An assembly according to claim 11 wherein said bracket means is formed with a partially cylindrically shaped end section.

13. An assembly according to claim 1 further comprising a cable tensioning insert attached to said driven member and operable to wind said cable means thereabout for tensioning said cable means.

14. An assembly according to claim 13 wherein said cable tensioning insert includes a winding section for winding thereabout said cable means, said winding section having a reception aperture for a cable nipple provided in the region of said winding section.

15. An assembly according to claim 14 wherein said cable tensioning insert includes a fastening section furnished with cylindrical gearing adapted to engage in positive engagement into a section of said driven member having a correspondingly structured internal gearing.

16. An assembly according to claim 14 wherein said cable tensioning insert includes a fastening section which is constructed as an exterior polygon and which positively engages into a section of said driven member constructed as a correspondingly shaped interior polygon.

17. An assembly acccording to claim 15 or 16 wherein said cable tensioning insert is formed with a cylindrical guide section which is axially movably inserted into a guide aperture formed in said driven member, the axial length of said guide section exceeding that of said fastening section.

18. An assembly according to claim 15 or 16 wherein said fastening section and said section of said drive member which receives said fastening section interact in such a way that said cable tensioning insert inserted into said driven member may be rotated in a rotational direction but secured against rotation in an opposite direction.

19. An assembly according to claim 18 wherein said fastening section and said section of said driven member which receives said fastening section are constructed with interengaging rotating sawtooth systems, the teeth of at least one of said sawtooth systems being elastically flexible in the radial direction.

20. An assembly according to claim 13 wherein said cable tensioning insert is made of plastic.

21. An assembly according to claim 7 wherein said drive block is constructed symmetrically relative to a center plane of said block which extends at right angles to said longitudinal direction of said guide rail means.

22. An assembly according to claim 1 further comprising retaining elements for retaining said cable means on said driven member in the region of the longitudinal ends thereof.

* * * * *